US006353214B2

(12) United States Patent
Choi

(10) Patent No.: US 6,353,214 B2
(45) Date of Patent: Mar. 5, 2002

(54) AUTOMATIC COOKING COMPENSATION APPARATUS OF MICROWAVE OVEN AND METHOD THEREOF

(75) Inventor: Kyung-Hwan Choi, Changwon (KR)

(73) Assignee: LG Electronics Inc. (KR)

( * ) Notice: Subject to any disclaimer, the term of this patent is extended or adjusted under 35 U.S.C. 154(b) by 0 days.

(21) Appl. No.: 09/732,399

(22) Filed: Dec. 7, 2000

(30) Foreign Application Priority Data

Dec. 10, 1999 (KR) ..... 99/56701

(51) Int. Cl.[7] ..... H05B 6/68
(52) U.S. Cl. ..... 219/702; 219/720
(58) Field of Search ..... 219/702, 720, 219/715, 716, 506; 99/325

(56) References Cited

U.S. PATENT DOCUMENTS 5,352,874 A * 10/1994 Gong ..... 219/720
5,702,625 A * 12/1997 Choi ..... 219/702
6,013,906 A * 6/2000 Kim ..... 219/702

* cited by examiner

*Primary Examiner*—Philip H. Leung
(74) *Attorney, Agent, or Firm*—Ostrolenk, Faber, Gerb & Soffen, LLP

(57) ABSTRACT

The present invention relates to an automatic cooking of a microwave oven, in particular to an automatic cooking compensation apparatus of a microwave oven and a method thereof which is capable of solving a port number restriction problem of a microcomputer when data compensation corresponding to automatic cooking time is performed. The present invention can have data variable port as same as line number of a key matrix by using the data variable port for the cooking time compensation in conjunction with key input ports, accordingly the cooking data can be compensated as same as the number of line.

In other words, data variable value inputs from four~five up to eight are possible within the range permitted by the key matrix, accordingly the present invention is capable of varying all the automatic cooking data set in advance with low material expense and a simple hardware construction.

10 Claims, 4 Drawing Sheets

AUTOMATIC COOKING COMPENSATION APPARATUS OF MICROWAVE OVEN AND METHOD THEREOF

BACKGROUND OF THE INVENTION

1. Field of the Invention

The present invention relates to a microwave oven, in particular to an automatic cooking compensation apparatus of a microwave oven and a method thereof, which is capable of solving a port number restriction of a micro computer when data compensation is performed in accordance with automatic cooking time.

2. Description of the Prior Art

An automatic cooking using a microwave oven is executed according to an predetermined algorithm. Herein, the automatic algorithm yields a proper value based on an experimental value in product developing stage and performs the cooking by adapting it. However, compared with the situation in pilot-production of microwave oven, distributing range in electromagnetic wave varies with outer factor in the microwave oven after mass-production. Herein, the cavity placed beside a controller of the microwave oven is space for depositing and heating foodstuff. Accordingly, there is a need to perform data compensation about automatic cooking time of an automatic cooking menu after the microwave oven is produced. Herein, menus which require the data compensation are popcorn, beverage etc., and menus which do not requires the data compensation are potato, vegetable, snack etc.

As depicted in FIG. 1, the conventional microwave oven comprises a key scan and an input circuit 20 for inputting a key signal according to a key selection of a user by scanning the key with a certain time interval, and an automatic cooking data alternation detecting circuit 10 for detecting data alternation according to the automatic cooking menu as separated input ports.

The automatic cooking data alternation detecting circuit 10 uses an additional input port of a microcomputer, one automatic cooking time data alternation port is allotted to every input port by weight or dish category.

In other words, as depicted in FIG. 2, a line for providing data alternation information according to the automatic cooking time is connected to input ports P1, P2 of the microcomputer in the conventional microwave oven. Accordingly, codes 25, 35 allot data alternation information by differentiating a voltage value inputted to the microcomputer by each different resistance.

FIG. 3 is a flow chart illustrating the cooking time compensation operation of the microwave oven automatic cooking menu. As an example, a cooking time data alternation process about popcorn cooking will now be described.

A user selects a dish menu through the key scan and input circuit S100, and inputs a cooking start key S1110. The microcomputer judges whether the user select menu is the menu requiring data alternation for cooking time compensation S120. When the menu is not the menu requiring the cooking time compensation, the microcomputer perform the cooking by controlling an oscillation circuit during the cooking time T1 set in advance S160, 170.

When the user select menu is the popcorn dish requiring the data alternation for the cooking time compensation S100, the microcomputer reads an analog/digital value according to the data alternation of the cooking time from the automatic cooking data alternation detecting circuit S130.

In other words, the microcomputer reads the data from the input port P1 or P2 set in advance in accordance with weight of the popcorn through the S130, and yields add-subtract time T2 for the cooking time compensation according to the value S140.

And, the final cooking time is yielded by adding the add-subtract time T2 of the S140 to the automatic cooking time T1 set in advance and the automatic cooking according to it is controlled S150, 170.

Meanwhile, in the popcorn cooking, data alternation about the cooking time is not performed uniformly by weights, but the data add-subtract rate of the cooking time is different in accordance with 1.75 ounce, 3.0 ounce, 3.5 ounce. Accordingly, the microcomputer has to allot the one input port by the weight of the popcorn. When there is the three popcorn weights as described above, the microcomputer needs the three input ports.

However, when a low priced microcomputer is used, the number of the input ports for allotting to the automatic cooking data alternation detecting circuit are limited as two usually. Accordingly, when the input port P2 is allotted to the 1.75 ounce data requiring the most strict cooking time data so as to be variable, it is difficult to perform the accurate cooking about the 3.5 ounce popcorn cooking.

In addition, when the microcomputer having the high capability is used in order to increase the number of the input port, the manufacture cost increases. In other words, the conventional automatic cooking compensation apparatus of the microwave oven has a limit for performing the cooking time compensation with the conventional method which allots the ports of the microcomputer by the weight and dish menu when the cooking time has to be compensated in accordance with the automatic cooking menu and the cooking time compensation has to be adjusted differently by the weight or dish menu.

SUMMARY OF THE INVENTION

Accordingly, the object of the present invention is to provide an automatic cooking compensation apparatus of a microwave oven and a method thereof which is capable of performing cooking time data compensation without being restricted by number of ports when the cooking time data compensation is required in an automatic cooking menu of a microwave oven.

In order to achieve the above-mentioned object, the automatic cooking compensation method of the microwave oven according to the present invention comprises a designating step for designating a key input port as an analog port just after power is applied, a reading and storing step for reading and storing a data value for the automatic cooking compensation to the analog port, a alternation step for changing the key input port into the general key signal input port, a judging step for judging whether a select dish menu is the menu requiring the data compensation, and a compensating step for compensating the cooking time of the select dish menu on the basis of the stored compensation data value.

The automatic cooking compensation apparatus according to the present invention comprises a key matrix for scanning a key and outputting a signal corresponding to the selected key, an automatic cooking data alternation detecting means using an output port of the key matrix in conjunction with the key matrix in order to output a plurality of analog signals by dividing data alternation output signals differently each other through the key matrix output port, and a microcomputer connected with the output port of the key matrix with its input port in order to read an output signal of the automatic cooking data detecting means by designating the input port as an analog port when initial power is provided, and read a key selected in the key matrix by altering the input port to a general key input port when a main menu operates.

DETAILED DESCRIPTION OF THE PREFERRED EMBODIMENT

Hereinafter, an automatic cooking compensation apparatus of a microwave oven and a method thereof according to the present invention will now be described with reference to accompanying drawings.

Figure 1:
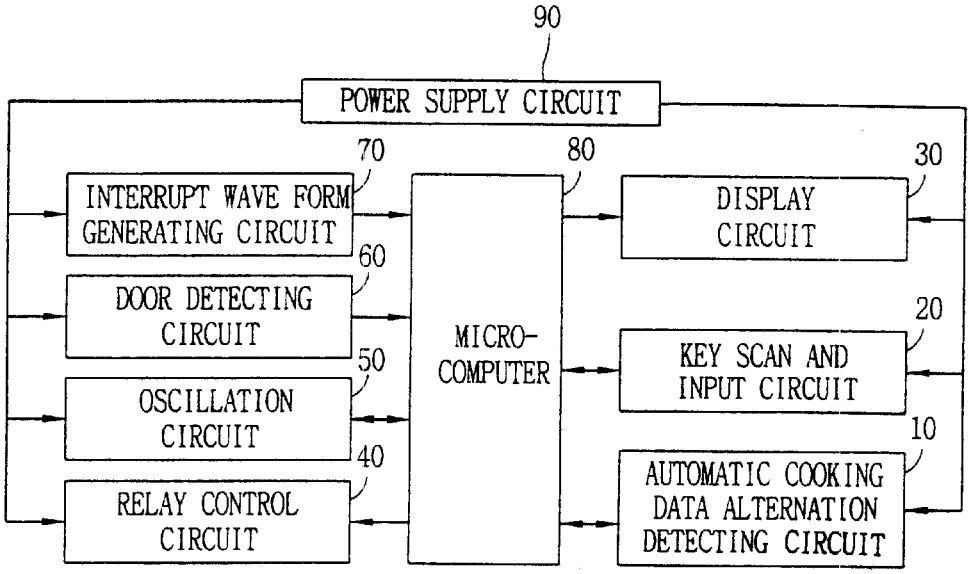
FIG. 1 (PRIOR ART)
FIG. 1 is a block diagram illustrating the conventional automatic cooking compensation apparatus of a microwave oven.
Figure 2:
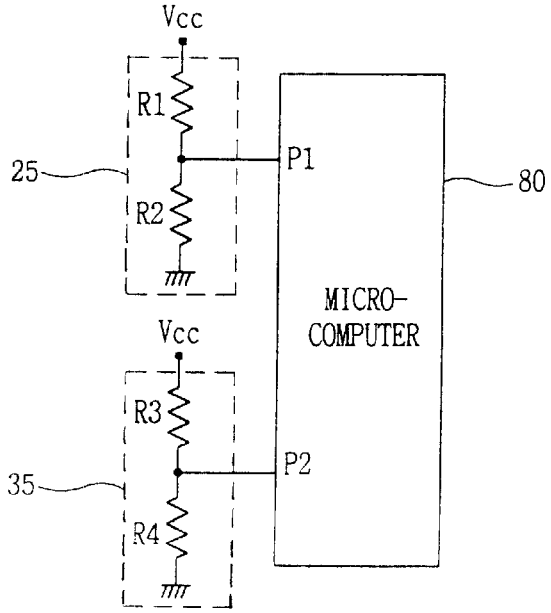
FIG. 2 (PRIOR ART)
FIG. 2 illustrates the conventional automatic cooking data alternation detecting circuit.
Figure 3:
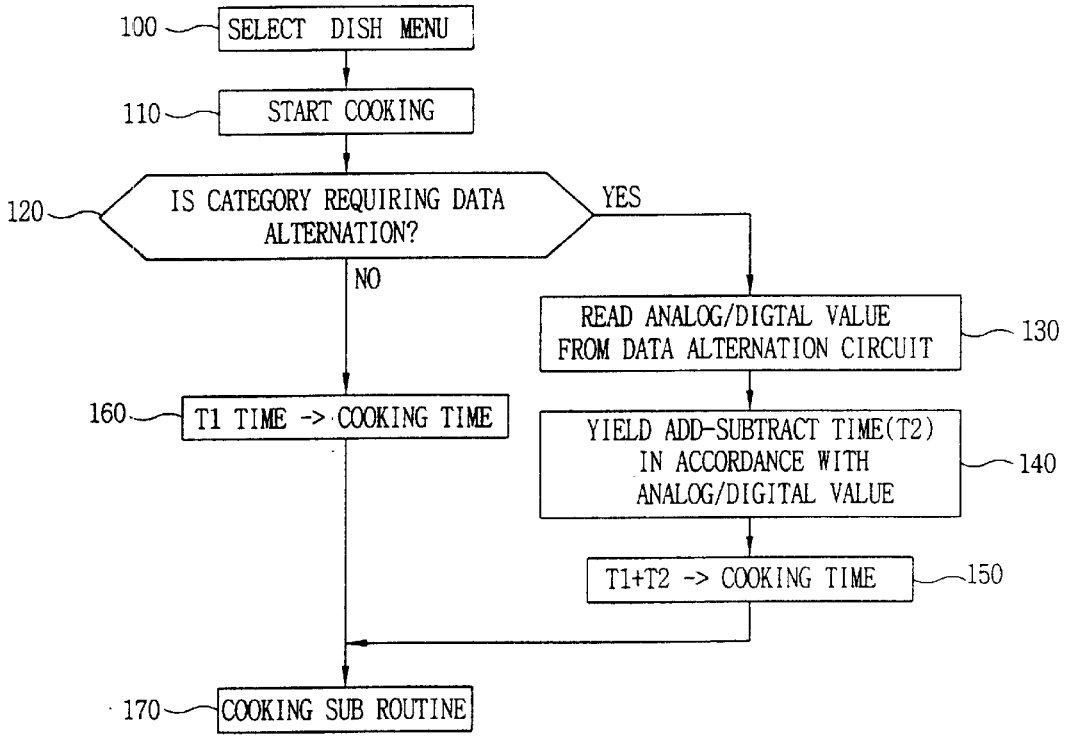
FIG. 3 (PRIOR ART)
FIG. 3 is a flow chart illustrating the conventional cooking time compensation operation in automatic cooking menu of the microwave oven.
Figure 4:
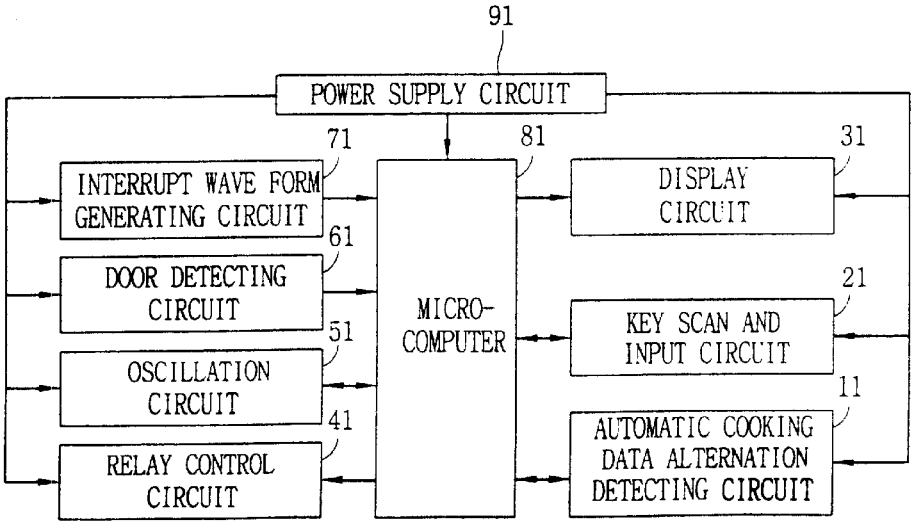
FIG. 4 is a block diagram illustrating an automatic cooking compensation apparatus of a microwave oven according to the present invention.

FIG. 4 is a block diagram illustrating an automatic cooking compensation apparatus of a microwave oven according to the present invention.

The automatic cooking compensation apparatus of the microwave oven according to the present invention comprises a key scan and an input circuit for scanning a key with a certain time interval in order to check whether a user selects a menu select key and a cooking start key etc. and input the select key, an automatic cooking data alternation detecting circuit for compensating cooking time data in accordance with the automatic cooking, a microcomputer for processing a signal outputted from the key scan and input circuit and data alternation detecting circuit, an oscillation circuit, a relay control circuit, a door detecting circuit, and an interrupt generating circuit connected to the microcomputer.

Figure 5:
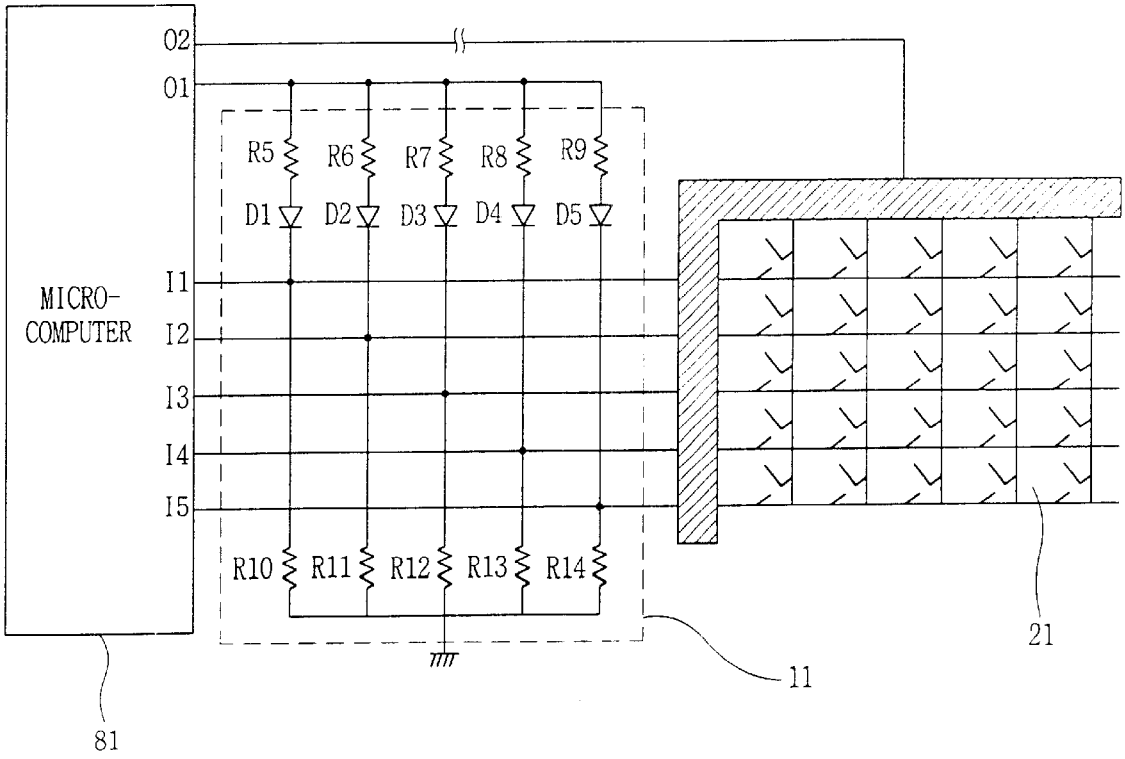
FIG. 5 is a detailed circuit diagram illustrating a key scan, an input circuit, an automatic cooking data alternation detecting circuit according to the present invention.

In other words, as depicted in FIG. 5, the microwave oven according to the present invention inputs a data variable value of the automatic cooking by using the key input port in conjunctive with the key matrix 21 within the range permitted by the key matrix 21.

Resistance R5~R9 having different resistance value each other are parallel-connected to a data alternation output port 01 of the automatic cooking data alternation detecting circuit 11 of the microwave oven.

The each resistance is serial-connected to pull down resistance R10~R14, the input ports l1~l5 of the microcomputer read the voltage partial-pressed by the resistance R5~R9 and R10~R14. Accordingly, the automatic data alternation detecting circuit 11 according to the present invention can have data variable port as same as number of the line of key matrix 21. Accordingly, data about the cooking time of the dish menu can be compensated as same as the number of the line.

And, diodes D1~D5 are switching diodes for blocking the resistance R5~R9 not to influence input voltage in key input.

The input ports l1~l5 of the microcomputer connected to the automatic cooking data alternation detecting circuit has to operate as analog input ports when the data according to the cooking time compensation of the automatic cooking menu is inputted. And, when the data input according to the cooking time compensation of the automatic cooking menu in accordance with the automatic cooking data alternation detecting circuit 11 is completed, the input ports l1~l5 of the microcomputer operate as the general input ports and input the key signal selected from the key matrix 21.

The microwave oven according to the present invention further comprises a display circuit 31 for displaying the present cooking menu and cooking time etc., a relay control circuit 41 besides the oscillating circuit 51 generating the microwave oven, a door detecting circuit 61 for detecting open/close of a door of the microwave oven by the voltage changing in accordance with the open/close of a micro switch installed beside the door, and an interrupt wave generating circuit 71 for generating a clock signal by depressing AC power through a transformer, and a power circuit 81 for providing power to the each circuit.

The operation process of the automatic cooking compensation apparatus of the microwave oven in accordance with the present invention will now be described.

Figure 6:
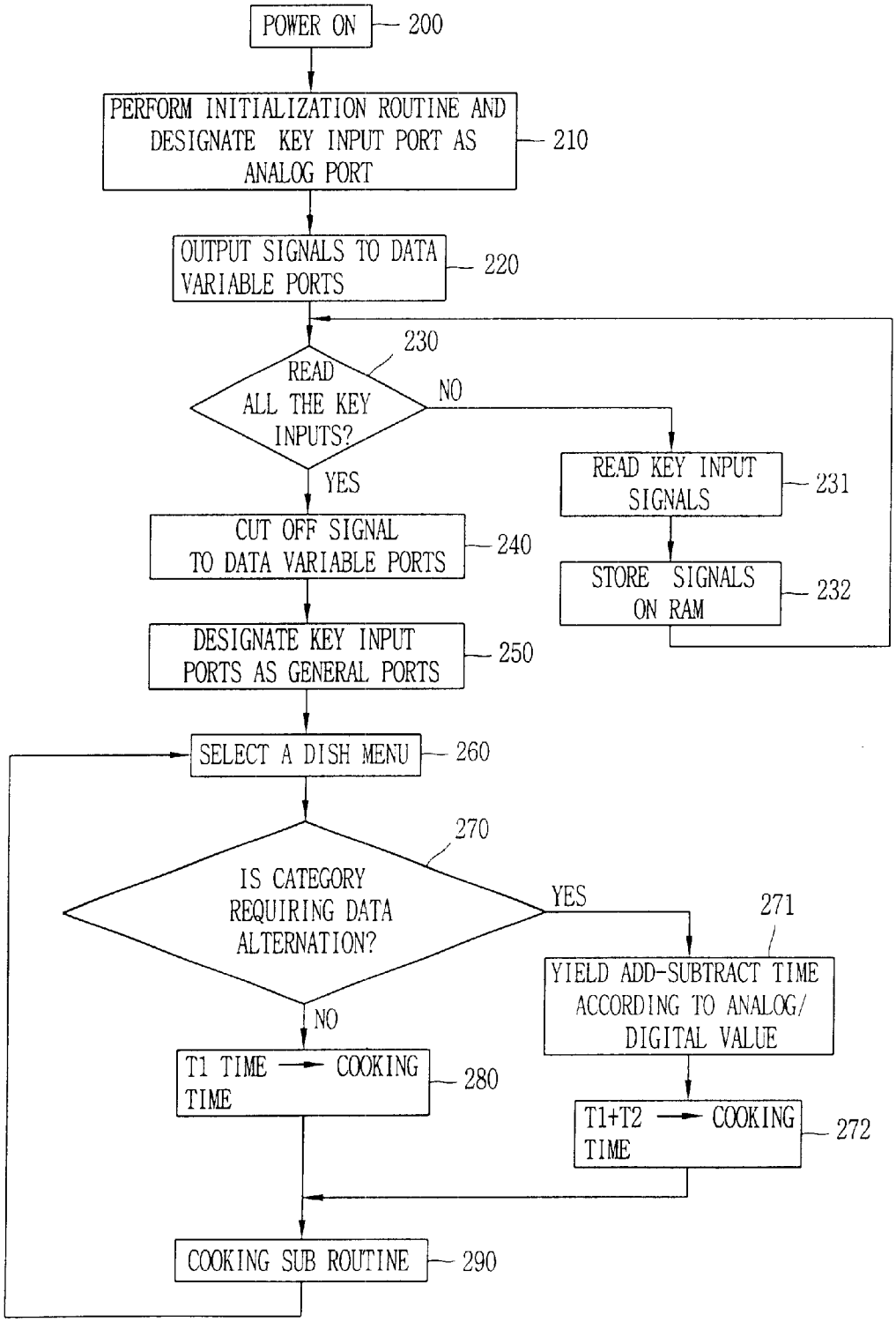
FIG. 6 is a flow chart illustrating an automatic cooking compensation operation of the microwave oven according to the present invention.

FIG. 6 is a flow chart illustrating an automatic cooking compensation of the microwave oven according to the present invention. Herein, when the initial power for cooking is provided to the microwave oven S200, the microcomputer performs an initial routine of the cooking time compensation of the automatic cooking menu before the microcomputer performs the algorithm about the select dish. Accordingly, the microcomputer designates the key input ports l1~l5 as the analog ports S210.

In order to read the cooking time compensation data of the automatic cooking menu, the microcomputer outputs a signal to the data variable output port 01 S220. In the S220, the output signal is providing voltage having a certain volume.

After that, the microcomputer reads the analog value of the each key input port l1~l5 S231. The key input port l1 reads the voltage partial-pressed by the resistance R5 and R10, the other key input port I2 reads the voltage partial-pressed by the resistance R6 and R11. The operation performs repeatedly as same as the number of the key input port.

And, the value read by the each key input port is stored on a ram S232.

The S231 and S232 are performed until the analog value is read from the all analog key input ports l1~l5 S230. When the condition of the S230 is satisfied, the microcomputer cuts off the signal output to the data variable output port 01 S240.

And, the microcomputer designates the key input ports l1~l5 from the analog ports to the general key input ports 8250.

The initial routine for reading the data for the cooking time compensation in the automatic cooking by using the microwave oven is completed by the steps up to the S250.

After that, a process for controlling the cooking by compensating the cooking time about the user select menu in the main routine for performing the automatic cooking using the microwave oven will now described.

When the user selects a certain key while the microcomputer scans the key with a certain time interval through the key scan output port 02, the microcomputer inputs the user select key to the key input ports l1~l5. When the key inputted to the key input port is a certain dish menu and after that the cooking start key is inputted S260, the microcomputer judges whether the select dish menu is the category requiring the data alternation S270.

When the data alternation is required in the S270, the analog/digital value stored on the ram is read in accordance with the select dish menu, the compensation time T2 of the cooking time in accordance with the value is yield S271. And, the final cooking time is yield by adding/subtracting the compensation time T2 to/from the cooking time T1 set in advance S272.

When the select dish menu does not require the data alternation in S270, the microcomputer recognizes the cooking time T1 set in advance S280.

After that, the heating is performed by the irradiation of the microwave (S290) while the oscillating circuit 31 operates under the control of the microcomputer during the cooking time determined by S280 or S272.

As described above, the automatic cooking compensation apparatus of the microwave oven and the method thereof according to the present invention is capable of varying all four~five cooking data set in advance with a small amount of material cost and a simple hardware construction. The present invention is not limited by the port number of the microcomputer different from the conventional technology, accordingly the microcomputer produced in advance can be used without discarding it.

In addition, the present invention is capable of inputting data variable values from four~five up to eight within the range permitted by the key matrix, the efficiency of the present invention is practically very big, on the contrary the theory of usage is very simple, accordingly the construction of the hardware is very simple.

Particularly, the present invention can be used efficiently in the automatic cooking of foodstuff such as the popcorn requiring the each different control in accordance with the weight.

What is claimed is:

1. An automatic cooking compensation method of a microwave oven, comprising:

a designating step for designating a key input port of a microcomputer as an analog port in order to perform an initial routine just after power is applied;

a reading and storing step for reading and storing a data value for the automatic cooking compensation on the analog port;

a preventing step for preventing the microcomputer from outputting signals to a data variable output port before a key input port is altered to a key signal input port;

an altering step for altering the key input port from the analog port to the key signal port;

a judging step for judging whether a selected dish is a menu requiring data compensation after a certain dish is selected; and a compensating step for compensating a cooking time of the selected dish menu on the basis of the stored compensation data value.

2. The automatic cooking compensation method of the microwave oven according to claim 1, wherein the microcomputer reads an analog value of each input port by outputting signals to the data variable output port in the reading step for reading the data value for the automatic cooking compensation.

3. The automatic cooking compensation method of the microwave oven according to claim 2, wherein the key input port reads the voltage value divided by a resistance.

4. The automatic cooking compensation method of the microwave oven according to claim 2, wherein the reading step for reading the data value is repeated as many times as the number of the key input port.

5. The automatic cooking compensation method of the microwave oven according to claim 1, wherein the microcomputer performs the altering step by receiving a voltage inputted to the key input port with the analog port by reading the automatic cooking alternation data, designating an input port on a program of the microcomputer in order to input a general control order according to the key matrix, and altering the port.

6. The automatic cooking compensation method of the microwave oven according to claim 1, wherein from the step for altering the key input port to the analog port to the step for altering the key input port to the key signal input port is an initial routine for reading the data for the cooking time compensation.

7. The automatic cooking compensation method of the microwave oven according to claim 1, wherein the compensation time is added or subtracted to/from the cooking time set in advance in the compensating step for compensating the cooking time when the select menu is the menu requiring the data compensation.

8. The automatic cooking compensation method of the microwave oven according to claim 1, wherein the judging step for judging whether the select menu is the menu requiring the data compensation and the compensating step for compensating the cooking time are the main routines for performing the automatic cooking.

9. The automatic cooking compensation method of the microwave oven according to claim 8, wherein the automatic cooking is performed with the irradiation of the microwave oven while an oscillation circuit operates under the control of the microcomputer for the determined cooking time.

10. The automatic cooking compensation method of the microwave oven according to claim 1, wherein when the cooking for data compensation is unnecessary in the menu selection step for data compensation, the dish is cooked for the cooking time set in advance.

* * * * *